United States Patent [19]

Wilson

[11] Patent Number: 4,920,643

[45] Date of Patent: May 1, 1990

[54] METHOD OF ASSEMBLING ELECTRICAL CONNECTOR

[75] Inventor: Ronald A. Wilson, Medway, Mass.

[73] Assignee: Microwave Development Laboratories, Needham, Mass.

[21] Appl. No.: 248,601

[22] Filed: Sep. 26, 1988

[51] Int. Cl.[5] ..... H01R 43/20

[52] U.S. Cl. ..... 29/876; 174/88 C; 264/230; 439/581

[58] Field of Search ..... 29/876; 174/88 C; 264/230; 439/581, 723, 743

[56] References Cited

U.S. PATENT DOCUMENTS

| | | | |
|---|---|---|---|
| 3,150,231 | 9/1964 | Clark | 174/88 C |
| 3,409,864 | 11/1968 | Hoffman | 264/230 X |
| 3,577,496 | 5/1971 | Hoffman | 264/230 X |
| 3,678,447 | 7/1972 | Ziegler, Jr. et al. | 174/88 C X |
| 3,758,916 | 9/1973 | Wetmore | 264/230 X |
| 4,110,716 | 8/1978 | Nikitas | 174/88 C X |
| 4,412,717 | 11/1983 | Monroe | 439/581 X |
| 4,556,271 | 12/1985 | Hubbard | 439/581 X |

*Primary Examiner*—Carl J. Arbes

*Attorney, Agent, or Firm*—Wolf, Greenfield & Sacks

[57] ABSTRACT

A method of assembling an electrical connector that includes an outer conductor body, an inner conductor and a resilient and deformable insulating sleeve. The method includes providing a bore in the rigid outer conductor body having an inwardly directed substantially annular ridge extending therefrom defining a minimum bore diameter of the outer conductor body. A bore is provided in the insulating sleeve along with a substantially annular recess in the outer surface of the sleeve. The maximum diameter of the insulating sleeve is provided greater than the minimum bore diameter of the outer conductor body when the insulating sleeve is at a rest position. The next step is radially compressing the insulating sleeve to a smaller diameter than at the rest position thereof. Next is inserting the insulating sleeve, while at least partially compressed, into the bore of the rigid outer conductor body to a position in which the rigid outer conductor body ridge is in alignment with the insulating sleeve recess. Finally, the inner conductor is inserted into the insulating sleeve bore.

41 Claims, 3 Drawing Sheets

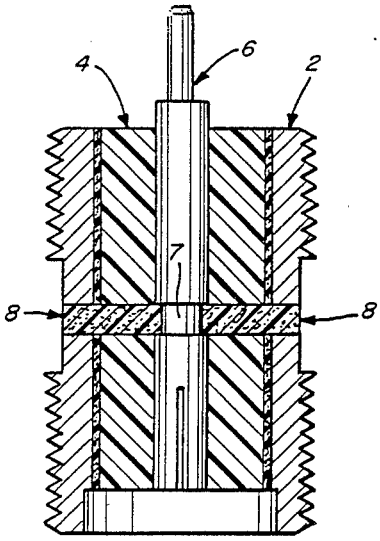
Fig.1
(PRIOR ART)
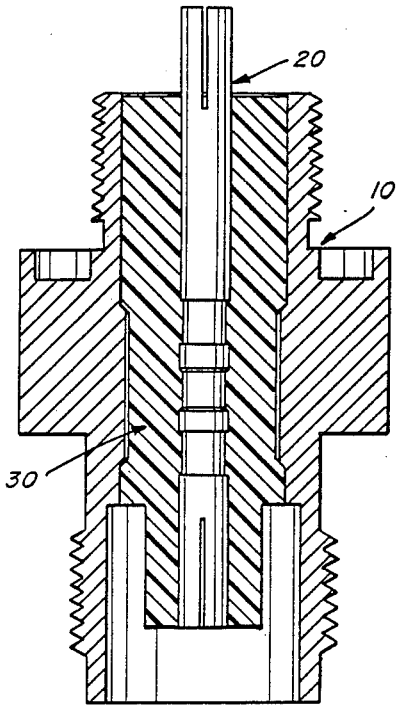
Fig.3 Fig.2
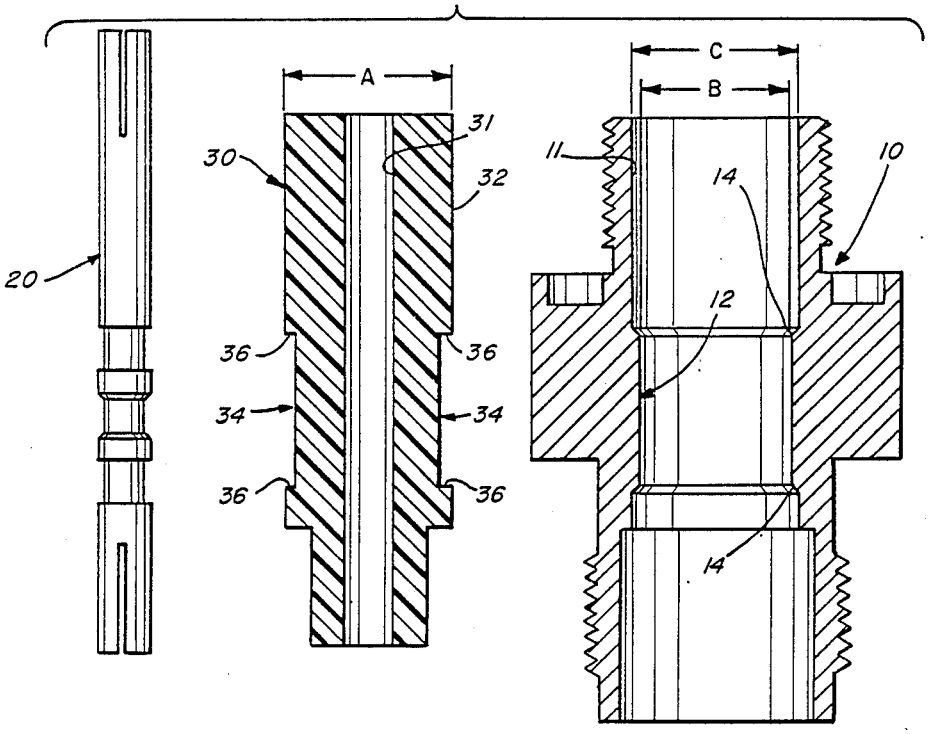

METHOD OF ASSEMBLING ELECTRICAL CONNECTOR

RELATED APPLICATIONS

The following are related applications pertaining to electrical connectors and the method of assembly thereof:

| Title | Ser. No. | Filed | |
|---|---|---|---|
| ELECTRICAL CONNECTOR | 610,268 | 5/14/83 | now abandoned |
| ELECTRICAL CONNECTOR | 579,404 | 2/13/84 | now abandoned |
| ELECTRICAL CONNECTOR | 729,642 | 5/2/85 | now abandoned |
| ELECTRICAL CONNECTOR | 864,739 | 5/13/86 | U.S. Pat. No. 4,755,325 |
| ELECTRICAL CONNECTOR | 183,974 | 4/20/88 | pending |

BACKGROUND OF THE INVENTION

1. Field of the Invention

The present invention relates in general to an electrical connector which may be of the jack-to-jack or barrel connector type having a center conductor and outer conductor. More particularly, the present invention relates to an improved method of assembly of an electrical connector. Even more particularly, the present invention relates to a method of assembly of an electrical connector so that the connector is mechanically tight and so that this mechanical tightness is maintained over an extended temperature range.

2. Background Discussion

At the present time, one common technique for positioning and retaining a center conductor in a barrel connector or jack-to-jack connector is with the use of an epoxy pin disposed generally between the center conductor and the connector body. In this regard, refer to FIG. 1 herein for an illustration of a typical prior art connector employing an epoxy pin. FIG. 1 illustrates the outer conductor body 2, an insulator 4, and a center conductor 6. The center conductor 6 is undercut at 7.

In order to introduce the epoxy and form the pins 8 illustrated in FIG. 1, one or more holes are drilled in the connector body and through the insulator so that the epoxy forms a pin engaging between the outer conductor body and the center conductor.

There are a number of problems associated with this epoxy pin technique. There tends to be electrical leakage at the hole provided in the connector body. Moreover, it is difficult to provide a uniform epoxy pin extending through the connector body into the center conductor and thus there may be some variance in the electrical characteristics of the connector depending upon the exact configuration of the epoxy pin. When a reduced diameter ring (undercut) is used in the center conductor such as illustrated in FIG. 1 herein, to enable engagement of the epoxy, then this ring generally has to be sufficiently deep to provide a proper epoxy bond. However, the depth of the undercut provides further electrical mismatch which is undesired. Furthermore, the epoxy is generally quite messy to use and many times gets on to electrical components where it is not desired, many times interrupting proper electrical contact and requiring disassembly of the connector.

There are also a number of steps required in using the epoxy pin retaining technique.

Another method that is used in retaining the center conductor in the proper position in the connector body is referred to as a "staking" technique. This requires the dimpling of the outer shell of the connector. However, this "staking" technique is generally unreliable. Moreover, in association with this technique it is hard to control the depth of penetration of the dimple relative to the center conductor.

My earlier copending applications referred to herein also describe other methods of assembly of electrical connectors. One such technique employs a Teflon sleeve that is adapted to be press-fitted into the body followed by the application of heat so as to expand the Teflon to provide proper interlocking between the Teflon and the inner and outer conductor parts. One problem with this technique is that the press-fitting step can cause damage to the connector components. Also, the application of heat for expanding the Teflon sleeve is a step that can be unpredictable, particularly because of the tendency of the Teflon sleeve to return to its original configuration.

OBJECTS OF THE INVENTION

Accordingly, it is an object of the present invention to provide an improved method of assembly of a coaxial-type connector in which it is preferred that the method of assembly be carried out without requiring the application of heat.

Another object of the present invention is to provide an improved coaxial-type electrical connector in which the electrical connector is characterized by having an improved mechanically tight seal.

A further object of the present invention is to provide an improved electrical coaxial connector in which the connector inner and outer conductor parts are maintained in a rigid mechanical interconnecting relationship.

Still a further object of the present invention is to provide an improved method of assembly of an electrical connector and one in which the steps are carried out quite easily, requiring relatively few steps for completing the assembly.

Another object of the present invention is to provide an improved method of fabrication of a connector in which the connector is in particular made without degrading the electrical characteristics associated with the lines intercoupled by the connector.

A further object of the present invention is to provide an improved method of assembly of a coaxial electrical connector, and one in which the inner and outer conductors are mechanically tightly positioned relative to each other and are maintained in that position in use over a extensive temperature range.

Still another object of the present invention is to provide an improved method of assembly of an electrical connector, and in which the method may be carried out in the construction of either symmetric or asymmetric electrical connectors.

SUMMARY OF THE INVENTION

To accomplish the foregoing and other objects, features and advantages of the invention, there is now described herein an improved method of assembling an electrical connector. The particular electrical connector that is being assembled is comprised of a rigid outer conductor body, an inner conductor, and a resilient and deformable insulating sleeve that is adapted to be supported between the rigid outer conductor body and the inner conductor. The method of the present invention comprises the steps of providing a bore in the rigid outer conductor body having an inwardly directed substantially annular ridge extending therefrom and defining a minimum bore diameter of the outer conductor body. Next there is provided a bore in the insulating sleeve along with a substantially annular recess in the outer surface of the sleeve. This sleeve is constructed preferably of a material such as Teflon. In constructing the parts of the connector, the maximum diameter of the insulating sleeve is selected to be greater than the minimum bore diameter of the outer conductor body when the insulating sleeve is at a rest position. The next step in the method is that of radially compressing the insulating sleeve to a smaller diameter than the rest position diameter, followed by inserting the insulating sleeve, while at least partially compressed, into the bore of the rigid outer conductor body to a position in which the rigid outer body ridge is in alignment with the insulating sleeve recess. Next, the inner conductor is inserted into the insulating sleeve bore.

Further features of the present invention include, after the step of inserting the insulating sleeve into the outer conductor body, axially compressing the insulating sleeve to assist in moving the insulating sleeve back toward its at rest position diameter. The step of providing a ridge in the outer conductor body includes providing end bevel walls in part defining this ridge. Also, the step of providing a recess in the insulating sleeve includes providing end walls that extend substantially radially and are adapted to engage the bevel walls of the outer conductor body when the ridge and recess are in alignment. The step of axially compressing the insulating sleeve preferably includes the step of providing die members having associated prongs adapted for insertion into the bore of the insulating sleeve. To assist in insertion of the insulating sleeve in the outer conductor body, there is preferably also provided the step of lubricating between the rigid outer conductor body and the insulating sleeve. The step of radially compressing the insulating sleeve includes providing an insertion tool having a tapered hole therein whereby the insulating sleeve is compressed as it is forced therethrough and into the bore of the rigid outer conductor body. The step of inserting the inner conductor includes providing an insertion tool for inserting the inner conductor and associated protective pin means supported by the insertion tool for protecting the ends of the inner conductor as it is inserted. The method of assembly of the present invention may be employed in connection with both symmetrical and asymmetrical connector configurations. The principle of assembly of the connector of the present invention may be employed either in association with a ridge and recess configuration having automatic temperature compensation as described in my earlier copending applications, or the techniques of the present invention may also be employed in association with other forms of connector configuration.

However, in accordance with the present invention, it is preferred to practice the method of assembly in association with a connector configuration as described in my earlier copending applications in which the annular ridge has at opposite sides thereof, beveled end walls transitioning between the outer conductor body bore and the annular ridge. Similarly, the annular recess has, at opposite sides thereof, and at least in its mated position thereof, recess-defining beveled end walls transitioning between the outer diameter of the sleeve in the inner diameter of the sleeve at the annular recess. The bevelled end walls of both the ridge and recess are in contact. A clearance is preferably provided between the insulating sleeve and the outer conductor so as to enable temperature expansion between the parts. However, the actual contact between the sleeve and the outer conductor is only at the beveled surfaces which always stay in intimate but relative sliding contact over temperature ranges. The opposed beveled end walls of respective body and sleeve lie on the surfaces of cones which each have a common vertex which is usually, but not necessarily disposed on the connector axis.

BRIEF DESCRIPTION OF THE DRAWINGS

Numerous other objects, features and advantages of the invention should now become apparent upon a reading of the following detailed description taken in conjunction with the accompanying drawing, in which:

FIG. 1 is a cross-sectional view of a prior art connector design employing an epoxy pin technique for assembling connector components;

FIG. 2 is a cross-sectional view of an assembled connector as in accordance with the present invention, illustrating in particular the outer conductor body, the center conductor and the insulating sleeve;

FIG. 3 is an exploded view of the three basic components of the connector illustrated in their "rest" position prior to assembly;

DETAILED DESCRIPTION

Figure 4:
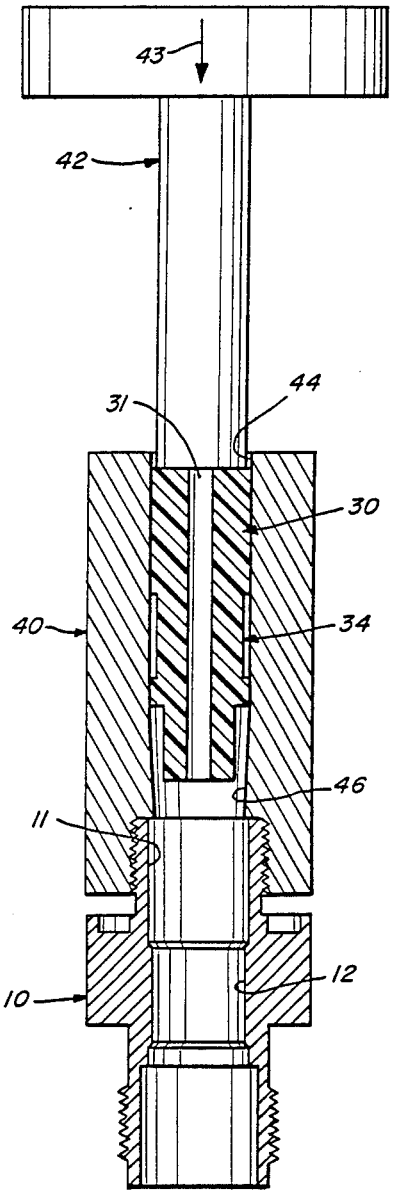
FIG. 4 is a cross-sectional view illustrating an initial step in the assembly of the connector with the insulating sleeve undergoing compression and insertion into the outer conductor body.

FIG. 2 is a cross-sectional view of the connector constructed in accordance with the assembly techniques of the present invention. As noted in FIG. 2, this connector is of coaxial type and includes an outer conductor body 10 an inner conductor 20 and an insulating sleeve 30. The principles of the present invention may be employed in connection with the making of any type of a connector in which inner and outer connectors are to be relatively supported. In FIG. 2 the inner conductor 20 and the outer conductor body 10 may be constructed of standard metal material. The insulating sleeve 30 is preferably a Teflon sleeve. Teflon has good cold flow properties, but in addition, the Teflon sleeve also has a "memory" which means that it will tend to revert back to a normal "rest" position after being deformed. It is this "memory" characteristic of the Teflon sleeve that is taken advantage of in accordance with the present invention in providing the improved method of assembly described herein.

FIG. 3 is an exploded view illustrating the components of the connector as considered in their "at rest"

state. In this regard, it is noted that the outer conductor body 10 has an inner bore 11 with an inwardly directed substantially annular ridge 12 extending therefrom. The ridge 12 is defined at its ends by respective beveled end walls 14 that transition from the ridge 12 to the bore 11. For an enlarged view of the ridge 12 and beveled end walls 14, refer to the enlarged fragmentary view of FIG. 7 herein.

Now, with reference to FIG. 3, there is also illustrated the insulating sleeve 30 which, as indicated previously, is preferably of a Teflon material. The sleeve 30 has an inner bore 31 that is adapted to accommodate the inner conductor 20, to be described hereinafter. The sleeve 30 also has defined in its outer surface 32, an annular recess 34. The recess 34 is defined by end walls 36 which in the preferred embodiment are not beveled, but are instead disposed at a 90° angle as is illustrated in FIG. 3. The length of the recess 34 between the walls 36 is selected so that when the components are in their assembled position, such as is illustrated in FIG. 2, the walls 36 deform and essentially match the configuration of the beveled walls 14 of the rigid outer conductor body. In this regard, refer to FIGS. 2 and 7 herein.

As just indicated, the distance between the walls 36 is selected so that the walls become depressed and match the configuration of the beveled walls 14 of the outer conductor body. In this regard, the distance between the walls 36 is preferably about the same as the distance between the mid-points along the restrictive beveled walls 14.

Figure 5:
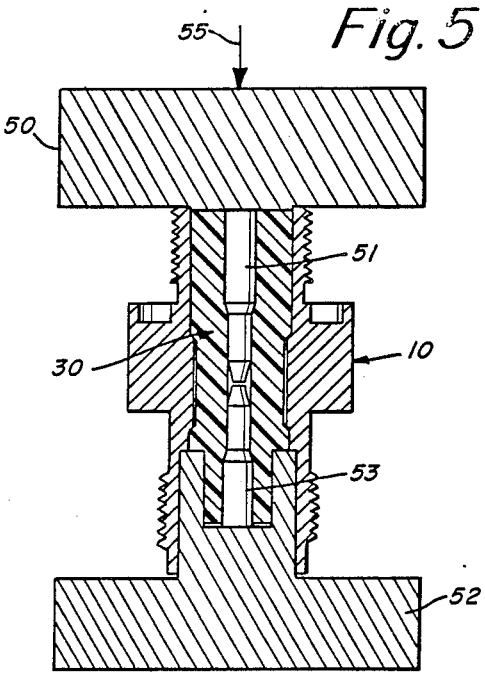
FIG. 5 is a cross-sectional view illustrating a next step in the method of assembly including the axial compression of the insulating sleeve so as to assist in reconfiguration of the sleeve with the outer conductor body bore.
Figure 6:
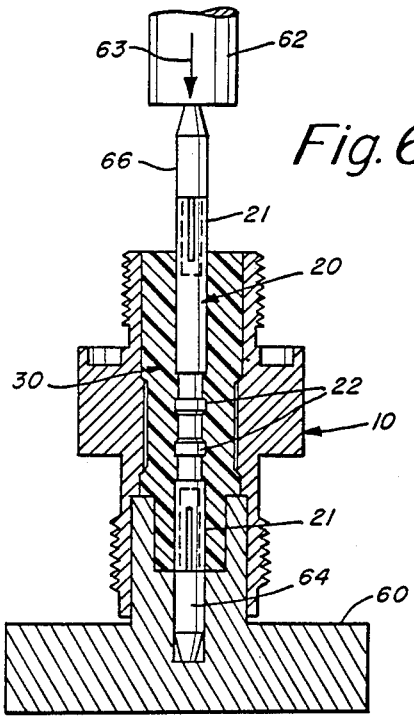
FIG. 6 is a cross-sectional view illustrating a next step in the assembly, that of inserting the center conductor in the insulating sleeve.

Reference is now made to FIGS. 4–6 for illustrations of the sequence of assembly of the connector as in accordance with the principles of the present invention. In this regard, FIG. 4 illustrates an initial step relating to the compression and insertion of the insulating sleeve into the outer conductor body. For this purpose, there is provided a tool that is comprised of a body 40 for supporting a plunger 42. The body 40 has a central bore 44 which is cylindrical bore at its top end but also having at its bottom end, a tapered bore as illustrated at 46 in FIG. 4. In FIG. 4 the insulating sleeve 30 is shown disposed in a position wherein the sleeve is about to reach the taper 46 for providing compression of the sleeve.

Now, as an initial step prior to actual compression and insertion, a lubricant such as an oil or grease based lubricant is disposed about the insulator, and/or inside the bore 11 of the outer conductor body. After the lubricant has been applied, then the plunger 42 is moved in the direction of arrow 43 as illustrated in FIG. 4, and this moves the insulating sleeve 30 downwardly in the bore of the body 40. The taper 46 causes compression of the sleeve 30. Because the Teflon tends to return back to an initial state, the compression is only temporary. However, the action of the plunger can be carried out quite rapidly and thus the compression by virtue of the taper 46 retains sufficient compression of the sleeve 30 so that the sleeve can easily pass the ridge 12 and the bore 11 of the outer conductor body without causing damage, tearing or deformation of the sleeve 30.

The compression and insertion tool is preferably constructed so that when the plunger 42 bottoms out, the ridge 12 and the recess 34 are essentially in alignment and engagement. This would be a position such as that illustrated in FIGS. 2 or 5. In other words, the ridge 12 extends into the recess 34.

Thus, FIG. 4 illustrates the concurrent steps of radial compression of the sleeve with insertion thereof into the outer conductor body. In this regard, it is noted that the components, as illustrated prior to assembly in FIG. 3, are dimensioned so that they are very close to their final desired dimensions after assembly. Thus, the outer diameter of the sleeve 30, namely dimension A in FIG. 3 is close to but slightly smaller by one or two thousandths of an inch than the inner bore of the outer conductor body, namely dimension C in FIG. 3. The diameter A in FIG. 3 is larger than the diameter at the ridge of the outer conductor body, this particular dimension is illustrated in FIG. 3 by the dimension B.

Figure 7:
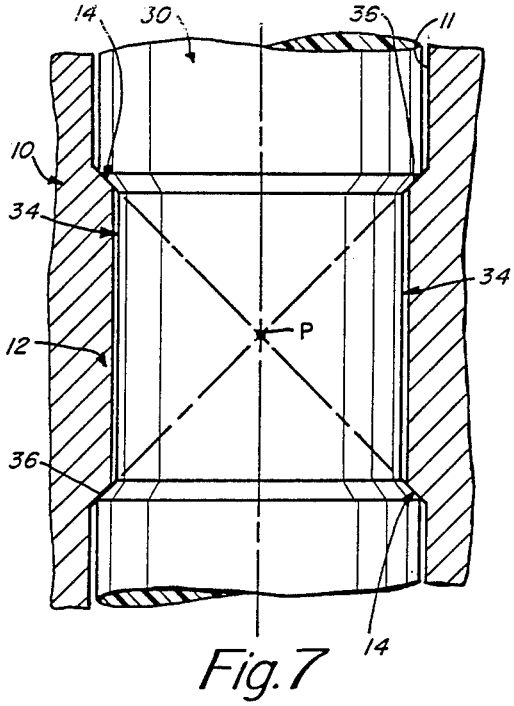
FIGS. 7–10 illustrate several different embodiments for the connector configuration including both symmetric and asymmetric versions with which the method of assembly of the present invention may be employed.

Now, when the Teflon sleeve 30 is compressed, its outer diameter A is thus reduced so that it is on the order of or less than the dimension B so that the sleeve can easily pass the ridge and essentially engage therewith. Again, FIG. 7 illustrates the final position of the sleeve relative to the outer conductor body with the ridge 12 engaging with the recess 34 and with the squared end walls 36 defining the recess compressed so as to essentially match the tapered configuration of the beveled end walls 14.

It has been found that by providing the square walls 36, there is a tendency for increased pressure between the walls 36 and the walls 14. Because the Teflon has been made square at the wall 36, there is a tendency for the Teflon to want to retain that shape and thus it provides additional mechanical type pressure at this particular joint between walls 14 and 36.

Once the insulating sleeve 30 is fully into position in the outer conductor body 10, then the tool of FIG. 5 is employed to essentially mold the insulator back towards its original diameter configuration such as illustrated in FIG. 3. For this purpose, there are provided a pair of tools 50 and 52 of similar configuration. The tool 52 may be held stationary while the tool 50 may be moved in the direction of arrow 55. Each of the tools 50 and 52 have respective prongs 51 and 53. The tools 50 and 52 are moved from a relative standpoint toward each other and the prongs 51 and 53 engage in the center bore 31 of the insulating sleeve 30. It is noted that the prongs 51 and 53 preferably have stepped ends and are of a dimension to expand the inner diameter of the bore to thus essentially force the Teflon outwardly expanding the diameter thereof so as to assist in moving the Teflon sleeve back toward its initial rest position so as to provide complete interlocking between the ridge 12 of the outer conductor body and the recess 34 of the insulating sleeve 30.

The next step in the method of assembly is illustrated in FIG. 6 in which the center conductor 20 is then inserted through the bore 31 of the insulating sleeve 30. This step is accomplished after the tools 50 and 52 are withdrawn from the positions illustrated in FIG. 5. For the purpose of inserting the center conductor 20 in FIG. 6, there is provided a tool arrangement including a base 60 and a plunger 62 adapted to be moved in the direction of arrow 63. The base 60 may be held stationary. A protective pin 64 is supported in the base 60. The pin 64 extends into the fingers 21 at the end of the center conductor and is adapted to protect these fingers as the center conductor is inserted in place. Similarly, there is a pin 66 disposed at the other end of the center conductor at similar fingers 21 to protect these fingers when the center conductor is inserted into the insulating sleeve. FIG. 6 illustrates the final rest position of the center conductor in which certain annular rings 22 thereof are substantially in symmetric alignment with both the ridge 12 and the outer conductor body as well as the recess 34 in the insulating sleeve. The insertion of the center conductor 20 provides additional internal forces that can still further spread the insulating sleeve to expand its diameter so as to provide a proper match and interengaging relationship between the insulating sleeve 30 and the outer conductor body at the ridge and recess location.

Figure 8:
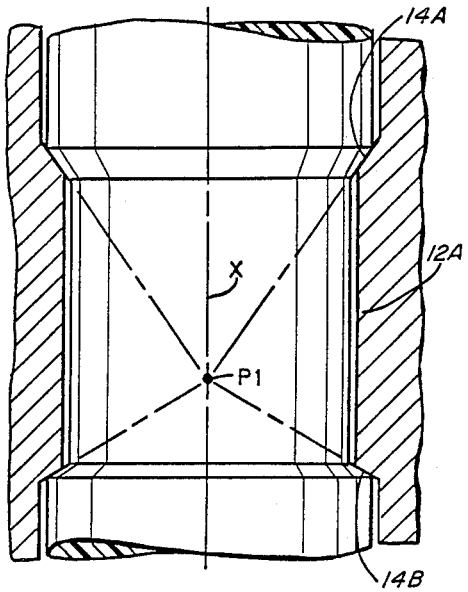
Figure 9:
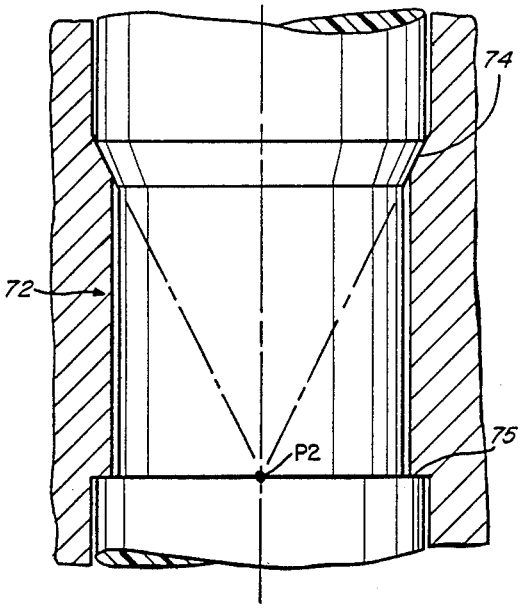
Figure 10:
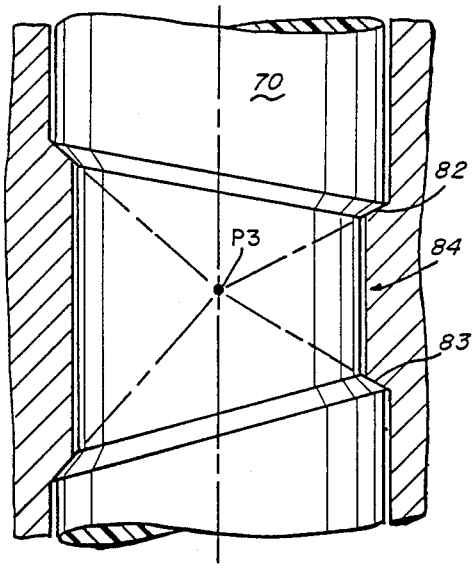

Reference has been made hereinbefore to FIG. 7 which is an enlarged view of the connector previously described. This connector configuration as well as the ones illustrated in FIGS. 8–10 are constructed in accordance with the principles as basically described in my earlier copending application Ser. No. 07/183,974 filed Apr. 20, 1988. This prior application illustrates ridge and recess configurations for both symmetric and asymmetric connector configurations. FIG. 7 illustrates the symmetric version and FIGS. 8–10 illustrate various asymmetric versions. In all of these different embodiments, it is noted that the beveled walls converge to a common point illustrated in FIG. 7 as the point P which actually is the vertex of mirror image cones, at least in the particular embodiment of FIG. 7. Thus, the beveled walls 14 in FIG. 7 are actually frusto-conic surfaces that all converge to a common point P. With this arrangement, as described in my earlier copending applications, mechanical tight fitness is maintained even over temperature deviations that the connector operates under. Thus, the wall surfaces of respective outer conductor and sleeve are maintained in contact by virtue of these principles with at least one of the wall surfaces of the respective body and sleeve being defined as a frusto-conic surface of a cone with the wall surfaces projectionable to a common vertex. This common vertex in the embodiment of FIG. 7 is the point P.

FIG. 8 illustrates a further embodiment of the connector configuration in which the vertex P1 is disposed on the axis X. In the embodiment of FIG. 8, both of the cones have the common vertex point at P1. In this particular arrangement, it is noted that the beveled end walls 14A and 14B of the ridge 12A have different tapers because the point P1 is not directly between the beveled walls, but is offset toward one beveled wall. The principles of assembly of the present invention can also be employed in connection with the connector configuration of FIG. 8.

FIG. 9 illustrates an embodiment of the connector construction in which the vertex has been moved to a point P2 so that there is essentially only one single conic configuration. In this particular embodiment, it is noted that the ridge 72 has one beveled end wall 74 at one end, but has a right angle wall 75 at the other end. The point P2 is disposed radially on the same line as the wall 75, as noted in FIG. 9. In this particular embodiment, it is preferred that the sleeve be inserted only from one side relative to the outer conductor body. As viewed in FIG. 9, the insulating sleeve would be inserted from above downwardly into the bore of the outer conductor body.

FIG. 10 illustrates still a further connector interlocking configuration. This is an asymmetric version in which the cones are not right angles cones, but are instead oblique cones defining the respective frusto-conic surfaces or end walls 82 and 83 of the ridge 84. In this particular embodiment, the insulating sleeve 70 is of a configuration to match the ridge configuration in the bore of the outer conductor body.

In FIG. 10, the configuration may be considered as one in which there are three inner cylindrical bores of the outer conductor body connected by two conical surfaces illustrated at 82 and 83 in FIG. 10. These are frusto-conic surfaces. When these surfaces are extended, they contain a common vertex, namely point P3 illustrated in FIG. 10. This represents the apex or vertex of each of these cones.

In the particular asymmetrical version of FIG. 10, because the ridge and recess are of varying length about the circumference thereof, when inserting the sleeve into the body, it is desired to provide respective markings on each component so that they can be inserted in proper radial position relative to each other. This can be accomplished quite easily by providing markings on the respective components.

Again, with reference to the particular configurations illustrated in FIGS. 7–10, reference may be made to my copending application Ser. No. 07/183,974 filed Apr. 20, 1988. In this earlier application, there are several derivations illustrating the principle of providing and maintaining contact, particularly at the beveled end walls of the recess between the outer conductor body and the insulating sleeve, particularly over relatively wide temperature ranges. In this regard, rather than the components expanding and contracting relative to each other, at those contact points along the frusto-conic surfaces, the parts slide relative to each other but maintain fixed contact.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A method of assembling an electrical connector that is constructed employing a rigid outer conductor body, an inner conductor, and a resilient and deformable insulating sleeve adapted to be supported between said rigid outer conductor body and said inner conductor, said method comprising the steps of, providing a bore in the rigid outer conductor body having an inwardly directed substantially annular ridge extending therefrom defining a minimum bore diameter of said outer conductor body, providing a bore in the insulating sleeve and a substantially annular recess in the outer surface of the sleeve, providing a maximum diameter of the insulating sleeve greater than said minimum bore diameter of the outer conductor body when said insulating sleeve is at a rest position, radially compressing said insulating sleeve to a smaller diameter than at said rest position absent the requirement for heat, inserting said insulating sleeve, while at least partially compressed, into the bore of said rigid outer conductor body to a position in which said rigid outer conductor body ridge is in alignment with said insulating sleeve recess, and inserting the inner conductor into said insulating sleeve bore after said insulating sleeve has been inserted into the bore of the outer conductor body.

2. A method of assembling an electrical connector that is constructed employing a rigid outer conductor body, an inner conductor, and a resilient and deformable insulating sleeve adapted to be supported between the rigid outer conductor body and the inner conductor, said method comprising the steps of, providing a bore in the rigid outer conductor body having an inwardly directed substantially annular ridge extending therefrom defining a minimum bore diameter of the conductor body, providing a bore in the insulating sleeve and a substantially annular recess in the outer surface of the sleeve, providing a maximum diameter of the insulating sleeve greater than the minimum bore diameter of the outer conductor body when the insulating sleeve is at rest position, radially compressing the insulating sleeve to a smaller diameter than at the rest position, inserting the insulating sleeve, while at least partially compressed, into the bore of the rigid outer conductor body to a position in which the rigid outer conductor body ridge is in alignment with the insulating sleeve recess, axially compressing the insulating sleeve to assist in moving the insulating sleeve back toward its rest position diameter, and inserting the inner conductor into the insulating sleeve bore.

3. A method as set forth in claim 2 wherein the step of providing a ridge in the outer conductor body includes providing end bevel walls in part defining said ridge.

4. A method as set forth in claim 3 wherein the step of providing a recess in the insulating sleeve includes providing end walls that extend substantially radially and that are adapted to engage the bevel walls of the outer conductor body when the ridge and recess are in alignment.

5. A method as set forth in claim 4 wherein the step of axially compressing the insulating sleeve includes the step of providing die members having associated prongs adapted for insertion into the bore of the insulating sleeve.

6. A method as set forth in claim 5 including lubricating between the rigid outer conductor body and insulating sleeve to assist in insertion of the insulating sleeve in the outer conductor body.

7. A method as set forth in claim 1 wherein the step of radially compressing the insulating sleeve includes providing an insertion tool having a tapered hole therein, whereby the insulating sleeve is compressed as it is forced therethrough and into the bore of the rigid outer conductor body.

8. A method as set forth in claim 7 including lubricating between said outer conductor body bore and said insulating sleeve to assist in compression and insertion.

9. A method of assembling an electrical connector that is constructed employing a rigid outer conductor body, an inner conductor, and a resilient and deformable insulating sleeve adapted to be supported between the rigid outer conductor body and the inner conductor, said method comprising the steps of, providing a bore in the rigid outer conductor body having an inwardly directed substantially annular ridge extending therefrom defining a minimum bore diameter of the outer conductor body, providing a bore in the insulating sleeve and a substantially annular recess in the outer surface of the sleeve, providing a maximum diameter of the insulating sleeve greater than the minimum bore diameter of the outer conductor body when the insulating sleeve is at a rest position, radially compressing the insulating sleeve to a smaller diameter than at the rest position, inserting the insulating sleeve, while at least partially compressed, into the bore of the rigid outer conductor body to a position in which the rigid outer conductor body ridge is in alignment with the insulating sleeve recess, providing an insertion tool for inserting the inner conductor and protective pin means supported by the insertion tool for protecting the ends of the inner conductor as it is inserted, and inserting the inner conductor into the insulating sleeve bore.

10. A method as set forth in claim 1 including lubricating between said outer conductor body bore and said insulating sleeve to assist in compression and insertion.

11. A method as set forth in claim 1 wherein the step of providing a ridge in the outer conductor body includes providing end bevel walls defining a symmetrical ridge.

12. A method of assembling an electrical connector that is constructed employing a rigid outer conductor body, an inner conductor, and a resilient and deformable insulating sleeve adapted to be supported between the rigid outer conductor body and the inner conductor, said method comprising the steps of, providing a bore in the rigid outer conductor body having an inwardly directed substantially annular ridge including end bevel walls defining an asymmetrical ridge, said ridge extending from the bore and defining a minimum bore diameter of the outer conductor body, providing a bore in the insulating sleeve and a substantially annular recess in the outer surface of the sleeve, providing a maximum diameter of the insulating sleeve greater than the minimum bore diameter of the outer conductor body when the insulating sleeve is at a rest position, radially compressing the insulating sleeve to a smaller diameter than at the rest position, inserting the insulating sleeve, while at least partially compressed, into the bore of the rigid outer conductor body to a position in which the rigid outer conductor body ridge is in alignment with the insulating sleeve recess, and inserting the inner conductor into the insulating sleeve bore.

13. A method as set forth in claim 12 wherein the end bevel walls have respective different angular tapers.

14. A method as set forth in claim 1 wherein the step of providing a ridge in the outer conductor body includes providing at least one end bevel wall.

15. A method as set forth in claim 14 further including a radial wall defining one side of the ridge.

16. A method of assembling an electrical connector that is constructed employing a rigid outer conductor body, an inner conductor, and a resilient and deformable insulating sleeve adapted to be supported between the rigid outer conductor body and the inner conductor, said method comprising the steps of, providing a bore in the rigid outer conductor body having an inwardly directed substantially annular ridge including end walls in part defining the ridge and being defined as a frusto-conic surface of a cone with all end walls projectionable to a common vertex, said ridge extending from the bore and defining a minimum bore diameter of the outer conductor body, providing a bore in the insulating sleeve and a substantially annular recess in the outer surface of the sleeve, providing a maximum diameter of the insulating sleeve greater than the minimum bore diameter of the outer conductor body when the insulating sleeve is at a rest position, radially compressing the insulating sleeve to a smaller diameter than at the rest position, inserting the insulating sleeve, while at least partially compressed, into the bore of the rigid outer conductor body to a position in which the rigid outer conductor body ridge is in alignment with the insulating sleeve recess, and inserting the inner conductor into the insulating sleeve bore.

17. A method of assembling an electrical connector that is constructed employing a rigid outer conductor body, an inner conductor, and a resilient and deformable insulating sleeve adapted to be supported between said rigid outer conductor body and said inner conductor, said method comprising the steps of, providing a bore in the rigid outer conductor body, providing interlocking surfaces between the bore of the outer conductor body and the outer surface of the insulating sleeve, providing a maximum diameter of the insulating sleeve greater than the minimum bore diameter of the outer conductor body when said insulating sleeve is at a rest position, radially compressing said insulating sleeve to a smaller diameter than at said rest position absent the requirement for heat, inserting said insulating sleeve, while at least partially compressed, into the bore of said rigid outer conductor body to a position in which said interlocking means are in alignment, and inserting the inner conductor into said insulating sleeve bore after said insulating sleeve has been inserted into the bore of the outer conductor body.

18. A method of assembling an electrical connector that is constructed employing a rigid outer conductor body, an inner conductor, and a resilient and deformable insulating sleeve adapted to be supported between the rigid outer conductor body an the inner conductor, said method comprising the steps of, providing a bore in the rigid outer conductor body, providing interlocking surfaces between the bore of the outer conductor body and the outer surface of the insulating sleeve, providing a maximum diameter of the insulating sleeve greater than the minimum bore diameter of the outer conductor body when the insulating sleeve is at a rest position, radially compressing the insulating sleeve to a smaller diameter than at the rest position thereof, inserting the insulating sleeve, while at least partially compressed, into the bore of the rigid outer conductor body to a position in which the interlocking means are in alignment, and inserting the inner conductor into the insulating sleeve bore to axially compress the insulating sleeve to assist in moving the insulating sleeve back toward its rest position diameter.

19. A method as set forth in claim 18 wherein the step of axially compressing the insulating sleeve includes the step of including die members having associated prongs adapted for insertion into the bore of the insulating sleeve.

20. A method as set forth in claim 19 including lubricating between the rigid outer conductor body and insulating sleeve to insist in insertion of the insulating sleeve in the outer conductor body.

21. A method as set forth in claim 17 wherein the step of radially compressing the insulating sleeve includes providing an insertion tool having a tapered hole therein, whereby the insulating sleeve is compressed as it is forced therethrough and into the bore of the rigid outer conductor body.

22. A method as set forth in claim 21 including lubricating between said outer conductor body bore and said insulating sleeve to assist in compression and insertion.

23. A method as set forth in claim 21 including providing an insertion tool for inserting the inner conductor and protective pin means supported by the insertion tool for protecting the ends of the inner conductor as it is inserted.

24. A method as set forth in claim 17 including lubricating between said outer conductor body bore and said insulating sleeve to assist in compression and insertion.

25. A method as set forth in claim 1 wherein the step of providing a ridge in the outer conductor body includes providing end bevel walls in part defining said ridge.

26. A method as set forth in claim 25 wherein the step of providing a recess in the insulating sleeve includes providing end walls that extend substantially radially and that are adapted to engage the bevel walls of the outer conductor body when the ridge and recess are in alignment.

27. A method as set forth in claim 26 wherein the step of axially compressing the insulating sleeve includes the step of providing die members having associated prongs adapted for insertion into the bore of the insulating sleeve.

28. A method as set forth in claim 27 including lubricating between the rigid outer conductor body and insulating sleeve to assist in insertion of the insulating sleeve in the outer conductor body.

29. A method as set forth in claim 17 wherein the step of axially compressing the insulating sleeve includes the step of including die members having associated prongs adapted for insertion into the bore of the insulating sleeve.

30. A method as set forth in claim 29 including lubricating between the rigid outer conductor body and insulating sleeve to insist in insertion of the insulating sleeve in the outer conductor body.

31. A method as set forth in claim 30 wherein the step of radially compressing the insulating sleeve includes providing an insertion tool having a tapered hole therein, whereby the insulating sleeve is compressed as it is forced therethrough and into the bore of the rigid outer conductor body.

32. A method as set forth in claim 31 including lubricating between said outer conductor body bore and said insulating sleeve to assist in compression and insertion.

33. A method as set forth in claim 32 including providing an insertion tool for inserting the inner conductor and protective pin means supported by the insertion tool for protecting the ends of the inner conductor as it is inserted.

34. A method as set forth in claim 33 including lubricating between said outer conductor body bore and said insulating sleeve to assist in compression and insertion.

35. A method of assembling an electrical connector that is constructed employing a rigid outer conductor body, an inner conductor, and a resilient and deformable insulating sleeve adapted to be supported between the rigid outer conductor body and the inner conductor, said method comprising the steps of, providing a bore in the rigid outer conductor body having an inwardly directed substantially annular ridge extending therefrom defining a minimum bore diameter of the outer conductor body, providing a bore in the insulating sleeve and a substantially annular recess in the outer surface of the sleeve, said insulating sleeve comprising a material having a tendency to revert back to a rest position after deformation, providing a maximum diameter of the insulating sleeve greater than the minimum bore diameter of the outer conductor body when the insulating sleeve is at a rest position, radially compressing the insulating sleeve to a smaller diameter than at the rest position, inserting the insulating sleeve, while at least partially compressed, into the bore of the rigid outer conductor body to a position in which the rigid outer conductor body ridge is in alignment with the insulating sleeve recess, and inserting the inner conductor into the insulating sleeve bore after the insulating sleeve has been inserted into the bore of the outer conductor body.

36. A method as set forth in claim 35 including, after the step of inserting said insulating sleeve into said outer conductor body, axially compressing the insulating sleeve to assist in moving the insulating sleeve back toward its rest position diameter.

37. A method as set forth in claim 36 wherein the step of providing a ridge in the outer conductor body includes providing end bevel walls in part defining said ridge.

38. A method as set forth in claim 37 wherein the step of providing a recess in the insulating sleeve includes providing end walls that extend substantially radially and that are adapted to engage the bevel walls of the outer conductor body when the ridge and recess are in alignment.

39. A method as set forth in claim 38 wherein the step of axially compressing the insulating sleeve includes the step of providing die members having associated prongs adapted for insertion into the bore of the insulating sleeve.

40. A method as set forth in claim 39 including lubricating between the rigid outer conductor body and insulating sleeve to assist in insertion of the insulating sleeve in the outer conductor body.

41. A method as set forth in claim 35 wherein the method is practiced absent the requirement for heat.

* * * * *